United States Patent [19]

Boulanger

[11] Patent Number: 4,641,121

[45] Date of Patent: Feb. 3, 1987

[54] SEALED ELECTRICAL SWITCH AND MOUNTING THEREFOR

[75] Inventor: Henry J. Boulanger, Nicholasville, Ky.

[73] Assignee: Texas Instruments Incorporated, Dallas, Tex.

[21] Appl. No.: 794,888

[22] Filed: Nov. 4, 1985

[51] Int. Cl.[4] ..... H01H 37/04; H01H 37/52

[52] U.S. Cl. ..... 337/380; 337/381; 310/68 C

[58] Field of Search ..... 337/380, 372, 112, 113, 337/381; 310/68 C; 200/302.1

[56] References Cited

U.S. PATENT DOCUMENTS

| | | | |
|---|---|---|---|
| 2,907,851 | 10/1956 | Moorhead et al. | 337/380 |
| 3,215,873 | 11/1965 | Kruger et al. | 310/68 C |
| 4,308,517 | 12/1981 | Peterson | 310/68 C |
| 4,349,806 | 9/1982 | Boulanger | 337/343 |
| 4,446,450 | 5/1984 | Boulanger et al. | 337/380 |
| 4,446,451 | 5/1984 | Boulanger | 337/380 |

*Primary Examiner*—Harold Broome
*Attorney, Agent, or Firm*—John A. Haug; James P. McAndrews; Melvin Sharp

[57] ABSTRACT

A sealed thermostatic electric switch has a heat responsive thermostatic element disposed in good heat transfer relationship with the closed end of a heat conductive cup shaped member. The side wall of the cup shaped member extends upwardly from the closed end and is spaced a selected distance from the housing of the switch. A plastic sleeve has one end tightly received over the side wall and adhesively secured thereto and another end closed except for a tubular portion extending therefrom with electrical leads of the switch extending from the switch through and beyond the tubular portion. The tubular portion has opposed wall portions which are in contact and coalesced with each other and with the aligned plastic insulation of the leads to effectively seal the tubular portion of the sleeve.

A mounting plate is welded to the bottom outer surface of the cup shaped member which interfits with a strap or clip for attachment to a surface whose temperature is to be monitored. In one embodiment a clip is provided with tabs receivable in slots formed between the mounting plate and the cup shaped member. The clip has downwardly depending opposed legs adapted to springingly receive therebetween a tubular conduit whose temperature is to be monitored. In other embodiments the mounting strap extends along the bottom surface of the cup shaped member and is captured there by the mounting plate.

19 Claims, 15 Drawing Figures

SEALED ELECTRICAL SWITCH AND MOUNTING THEREFOR

TECHNICAL FIELD

This inention relates generally to electric switches and more specifically to fluid seals for heat responsive electric switches and means for mounting such switches to a surface whose temperature is to be monitored.

BACKGROUND OF THE INVENTION

Heat responsive electric switches are used in many different applications to provide selected process controls. By way of example, switches of this type are shown and described in U.S. Pat. No. 4,349,806, the disclosure of which is herein incorporated by this reference. In such switches a heat responsive element, such as a snap acting theremostatic disc, is disposed in a thermally conductive cap which forms part of the switch housing assembly. The cap is placed in heat transfer relation with a surface whose temperature is to be monitored. Selected changes in temperature cause movement of the heat responsive element which is transmitted to a movable contact to cause an electric circuit to open or close in response to the temperature change.

An important factor in the widespread use of thermostatic switches of this type, in addition to their high degree of reliablility, has been the ability to provide the switches at a low cost. This in turn is the result of structure which has low material cost, is conducive to mass manufacturing techniques, is easily assembled and which required little or no calibration.

Among the many applications for which such thermostatic switches are used are ones in which the switches may be subjected to moisture and fluid flow such as when used for refrigeration defrost and ice maker controls. In such applications it is required to provide an effective seal from liquids for the switch. To answer this need, prior art theremostat switches have been sealed by placing them within a sleeve of plastic material extending around the thermally conductive cap and filling the open end of the sleeve through which the electric leads to the switch extend with epoxy material. While this can provide an effective seal, it results in several undesirable limitations. For example the time required for assembly of the completed sealed switch is significantly extended, for example, up to sixteen hours to permit adequate curing of the epoxy. This ties up storage space and requires special holding means for holding the switches while the epoxy is curing. In addition, the extra mass of material provided by the epoxy makes the thermostatic switch respond more slowly to sensed temperature changes, that is, it makes the device less sensitive.

It is an object of the invention to utilize a thermostatic switch which is use ful for a wide variety of applications in order to minimize unit cost through high volume mass manufcturing techniques and yet provide an effective seal for such switch for special applications which is inexpensive and does not significantly affect or degrade the response time of the switch. Another object of the invention is to provide an improved seal for a thermostatic electric switch which takes significantly less time to manufacture than prior art sealed switches. Yet another object of the invention is to provide an effective means to mount a sealed thermostatic switch to various surface configurations whose temperature are to be monitored.

SUMMARY OF THE INVENTION

Briefly, in accordance with the invention a thermostatic electric switch having a temperature responsive thermostat element disposed in a heat conductive cap is received in the closed end of a cup shaped member formed of heat conductive material and is clamped therein with the cap in good heat transfer relation with the cup shaped member. The cup shaped member has a side wall extending from the closed end which is spaced from the electric switch to provide appropriate electrical clearance between the terminals of the switch. According to a feature of the invention and end of a plastic sleeve is snuggly received about the side wall and is adhesively bonded to the side wall to effect a first seal.

According to a feature of the inention a tubular portion extends from the sleeve in a direction generally parallel to the longitudinal axis of the sleeve in one embodiment or laterally generally perpendicular to the longitudinal axis in another embodiment. Electric leads connected to the switch extend out through the tubular portion with opoosed wall portions of the tubular portion in contact and coalesced with each other and with the aligned plastic insulation of the electric leads to effect a second seal of the tubular portion of the sleeve.

According to a feature of the invention the switch is mounted on a surface whose temperature is to be monitored by means of a mounting plate fixed in optimum heat transfer relation, as by welding, to the bottom outer surface of the cup shaped member. In one embodiment for mounting the switch on a tube whose surface is to be monitored the plate has a pair of recesses formed in the plate each in communication with the respective side edge of the plate to form tab receiving pockets once the plate is welded to the cup shaped member. A tube mounting spring clip is generally U-shaped with first and second legs extending from a flattened bight portion, the bight portion comprising a pair of straps adapted to underlie the bottom surface of the cup shaped member. A tab extends from each leg and lies intermediate the strips and generally in the same plane as the straps. The legs are each formed with an inwardly extending portion which can be forced apart to fit over a tube and securely maintain the switch attached to the clip through the mounting plate, thermally coupled to the tube.

In another embodiment the moutnign plate has a single recess or grooved portion extending across the plate intermediate two opposite ends in order to accommodate a mounting element. The grooved portion is provided with a suitable detent, such as an aperture, which receives a projection formed on the mounting element to thereby lock the element against the bottom surface of the cup shaped member once the mounting palte is welded thereto. The element can be of various configurations such as a relatively flat elongated strap having an aperture at each of two opposite ends to receive suitable fasteners to attach the strap and switch to a surface whose temperature is to be monitored. The strap is preferbaly formed with a slight bow to facilitate handling so that the strap will not fall out of the grooved portion prior to installation.

Another configuration of the element includes an elongated strap having a flat mounting portion with a projection as in the previously described strap and another portion bent away from and then back toward the flat mounting portion. The portion extending toward the V-shaped section to accommodate a tube whose temperature is to be monitored.

BRIEF DESCRIPTION OF THE DRAWINGS

The details of the invention will be described in conjunction with the accompanying drawings in which.

Similar reference characters indicate corresponding parts throughout the several views of the drawings.

DESCRIPTION OF THE PREFERRED EMBODIMENTS

Figure 1:
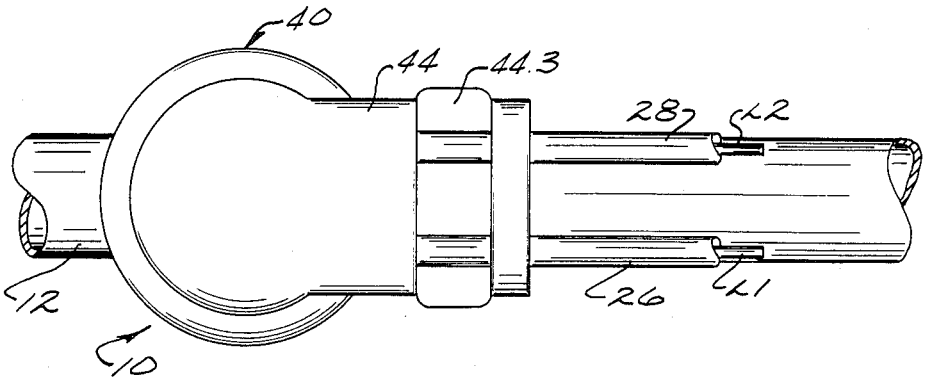
FIG. 1 is a top plan view of a sealed switch made in accordance with the invention mounted on a tube whose temperature is to be monitored.
Figure 2:
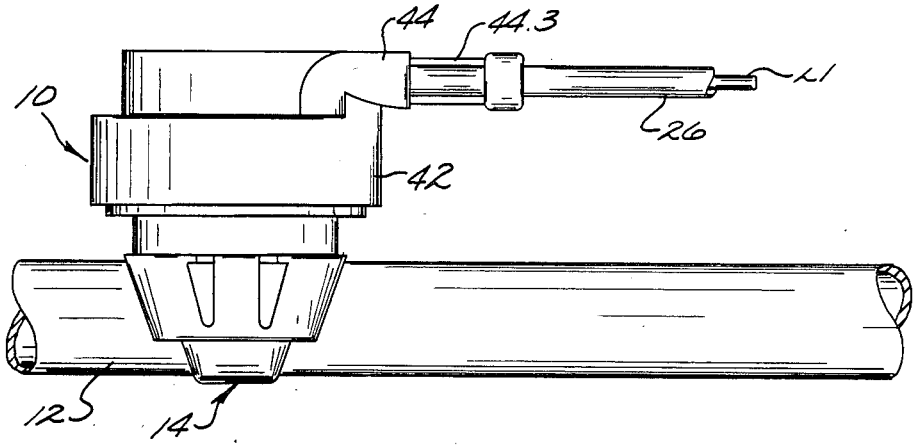
FIG. 2 is a front elevation of the FIG. 1 switch.

Referring to the drawings numeral 10 designates a sealed switch made in accordance with the invention and, as shown in FIGS. 1 and 2, in accordance with another embodiment of the invention, numeral 14 designates a novel mounting clip for mounting the switch on a tube 12 whose surface temperature is to be monitored.

Figure 3:
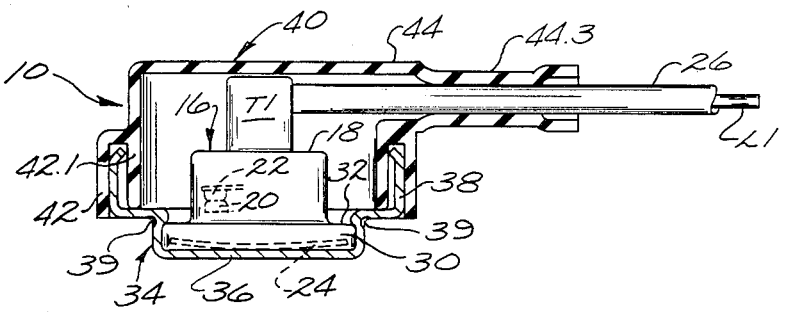
FIG. 3 is a cross section of a front elevation of the FIGS. 1, 2 switch without the tube and tube mounting structure.
Figure 11:
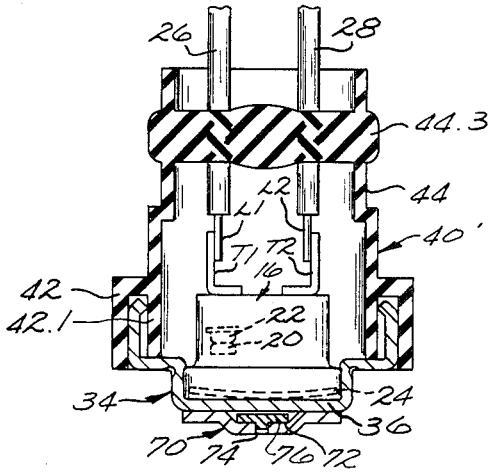
FIG. 11 is a view similar to FIG. 7 but showing a modified mounting plate and element for mounting the switch on a surface whose temperature is to be monitored.
Figure 12:
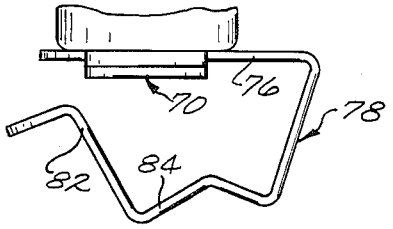
FIG. 12 is a side view of the mounting plate and element of FIG. 11.
Figure 13:
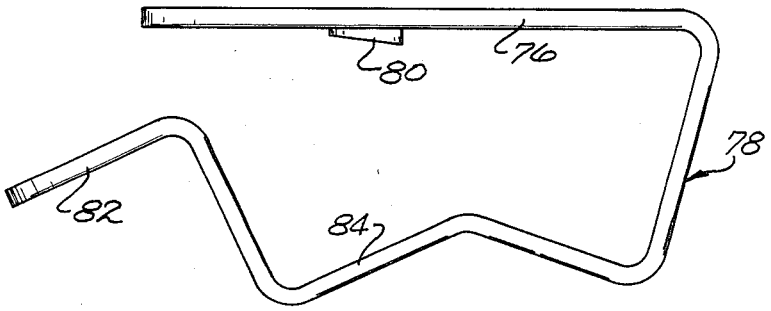
FIG. 13 is an enlarged view of the element of FIG. 12.

With particular reference to FIG. 3, sealed switch 10 comprises an electric switch such as a switch made in accordance with U.S. Pat. No. 4,349,806 referenced above. Switch 16 has a housing 18 in which a stationary contact 20 and a movable contact 22 are disposed with contact 22 adapted to move into and out of engagement with contact 20 to close and open an electric circuit under the control of a heat responsive thermostatic disc 24 which moves with snap action from one dished configuration (e.g. upwardly concave as shown in FIG. 3) to an opposite dished configuration (upwardly convex configuration, not shown). Contacts 20 and 22 are respectively electrically connected to terminals T1 and T2 (see FIGS. 7 and 11) which are in turn respectively connected to electric leads L1 and L2. Leads L1 and L2 are each provided with a respective layer 26, 28 of conventional plastic electrical insulative material such as polyvinyl chloride (PVC).

Housing 18 of switch 16 may be formed of a molded, electrically insulating plastic material and has an open end which is closed by a heat conductive cap 30 which is crimped at 32 to a flange formed at the open end of housing 18.

The seal for switch 16 comprises a cup shaped member 34 made of good thermally conductive material such as aluminum. Cup shaped member 34 has a generally flat temperature sensing bottom surface 36 and a generally cylindrical upstanding side wall 38 extending therefrom. Cylindrical wall 38 is formed with a first diameter or recess portion which is selected to closely receive the cap 30 of switch 16 and a second larger diameter portion which is selected to provide suitable electrical clearance over the surface of the housing 18. Switch 16 is securely mounted to cup shaped member 34 with cap 30 in close thermal coupling with the temperature sensing surface 36 of member 34 as by crimping or bending inwardly wall 38 at 39 over the flange formed on housing 18.

A sleeve 40 formed of suitable electrically insulative plastic material such a polyvinyl chloride, preferably the same material as that used for the layer on leads L1, L2, has a generally cylindrical portion 42 snuggly received over the larger diameter portion of wall 38 and is adhesively attached thereto completely around the outer perimeter of upstanding wall 38 to form a first seal. Preferably cylindrical portion 42 is formed with an inner lip 42.1 which is disposed inside side wall 38 to enhance the electrical separation betwen side wall 38 and housing 18 and terminals T1, T2.

Figure 4:
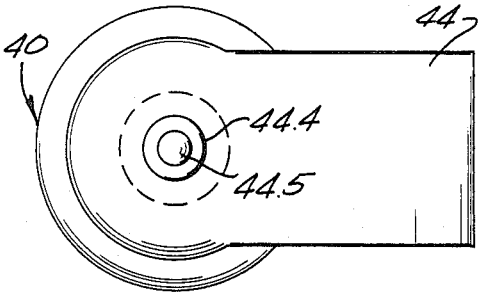
FIG. 4 is a top plan view of a modified sleeve used in sealing the switch prior to assembly.
Figure 5:
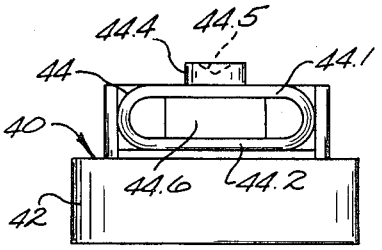
FIG. 5 is a side elevation of the FIG. 4 sleeve.

As seen in FIGS. 4 and 5, which show a modified sleeve 40 having an additional optional boss described below but which is otherwise the same as that shown in FIG. 3. Prior to assembly, the sleeve is formed with a flattened tubular portion 44 having opposed flattened walls 44.1 and 44.2 which extends from the sleeve in a direction laterally generally perpendicular to the longitudinal axis of cylindrical portion 42. Leads L1, L2 are trained through tubular portion 44 and a second seal is effected by causing the plastic material of opposed flattened wall portions of tubular portion 44 to coalesce with each other and with aligned portions of plastic layers 26, 28 as indicated by 44.3 by suitable means as by ultrasonically welding the material together or by use of radio frequency heating or by adhesive or solvent bonding. In making a sealed switch in accordance with the invention a matching platen and anvil having a generally flat mating surface with a pair of cylindrical grooves were brought toward each other through flattened walls 44.1 and 44.2 with leads L1, L2 aligned with the grooves at the same time that radio frequency energy was transmitted between the platen and anvil through the plastic to coalese the vinyl material and form a fluid tight seal.

As mentioned above, FIGS. 4 and 5 show the addition of a boss 44.4 which is optionally provided and not shown in FIG. 3. Boss 44.4 can be molded as part of sleeve 40 and comprises an upstanding section having a conical depression 44.5 and a electrical barrier portion 44.6 disposed between the terminals and extendign down to the top surface of the housing 18. If desired, the switch can be biased against a surface whose temperature is to be monitored by placing a conventional clip or strap over the switch with boss 44.4 extending through an aperture in the clip or strap to maintain the switch in a selected position.

Figure 6:
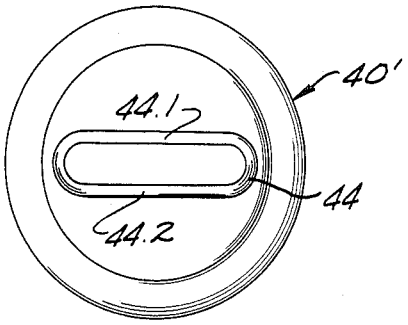
FIG. 6 is a top plan view of another modified sleeve prior to assembly used for electrical leads extending vertically from the switch.
Figure 7:
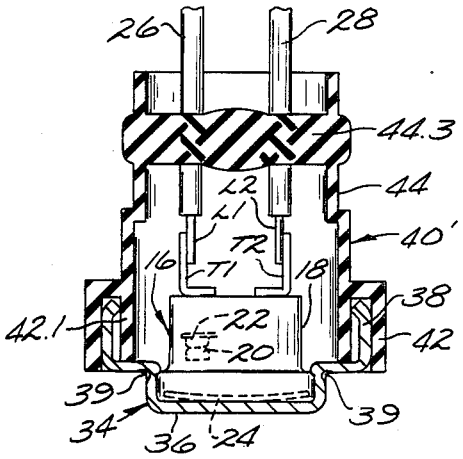
FIG. 7 is a view similar to FIG. 3 with the switch employing the FIG. 6 sleeve.

FIG. 7 shows an alternate embodiment in which tubular portion 44 of sleeve 40' extends in a directio generally parallel to the longitudinal axis of cylindrical portion 432. FIG. 6 shows the sleeve prior to assembly. In other respects the structure is the same as that of FIG. 3 and need not be redescribed.

A sealed switch made in accordance with the invention may be assembled by applying adhesive to side wall 38 of the cup shaped member 34 by spreading a thin layer all around the outer periphery of the large diameter portion of wall 38. Any suitable adhesvie which can bond plastic to metal can be used, generally a moisture and plasticizer resistant polymer applied for example as a hot melt or dissolved ina solvent. One such adhesive which has been found to be effective when the plastic is polyvinyl chloride and the cup shaped member is aluminum is a plastic adhesive 4475 of 3M Company. This adhesive comprises methyl ethyl ketone, polyurethane and vinyl chloride/acetate copolymer resin and antioxidant blend. The adhesive is allowed to harden tack free and then the electric switch 16 is inserted in the cup which is then crimped at 39. Sleeve 40 is pushed over the adhesive and this assembly is placed in a tool fixture to locate the parts and hold leads L1, L2 straight. The adhesive is heated to about 400° F. very quickly as by using an inductive heat coil around the cup shaped member. Upon reaching the desired temperature level the coil is deenergized with fast cooling resulting as the heat diffuses into the remainder of the switch. The tubular portion is then sealed to itself and to the leads using dielectric sealing equipment as mentioned above.

Figure 8:
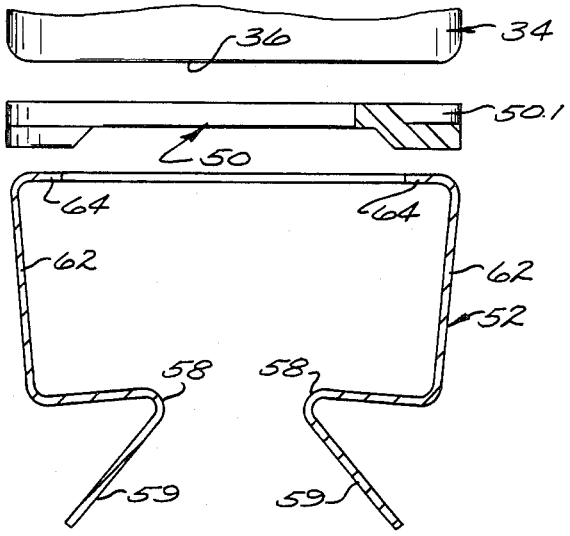
FIG. 8 is a view, partly in cross section, of a blown apart mounting structure including a mounting plate and a tube mounting clip, the cross sectional view of the clip portion being taken on line 8—8 of FIG. 10.
Figure 9:
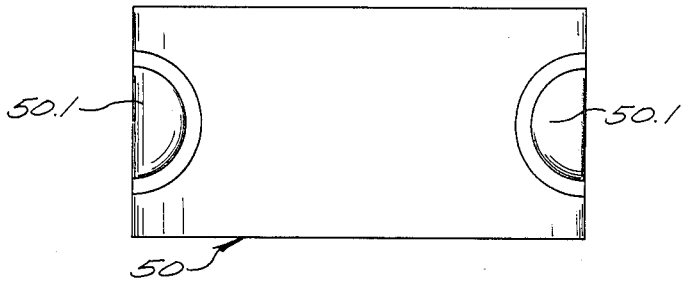
FIG. 9 is a top plan view of the mounting plate shown in FIG. 8.
Figure 10:
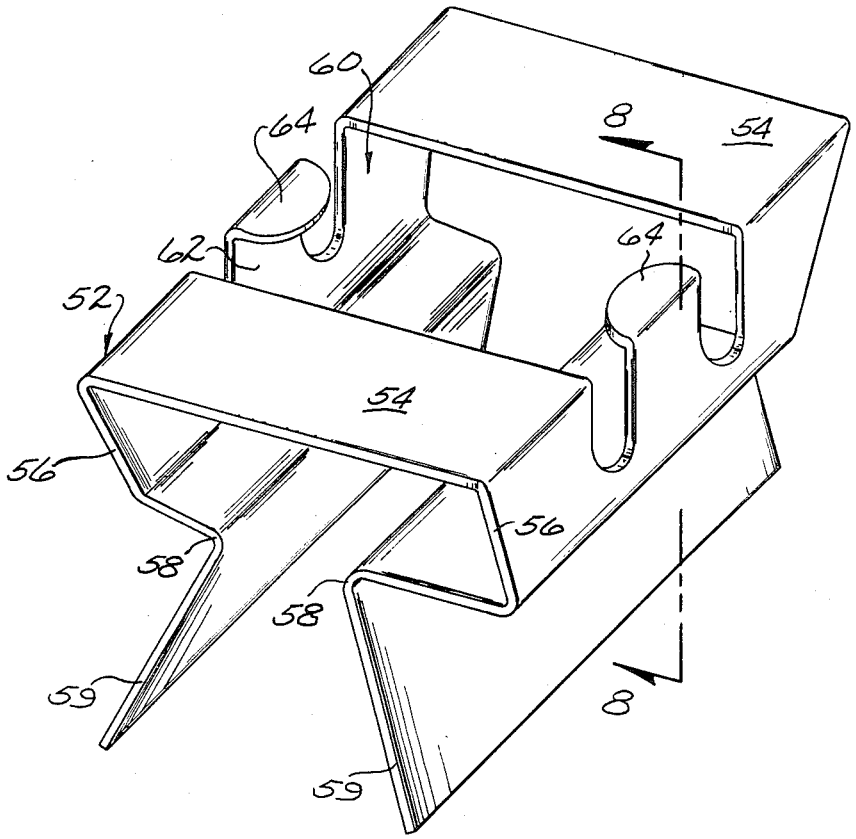
FIG. 10 is a perspective view of the tube mounting clip shown in FIGS. 2 and 8.

FIGS. 8–10 show an embodiment, for mounting the sealed thermostatic switch onto a tube whose surface temperature is to be monitored. As seen in FIG. 8, the bottom portion of cup shaped member 34 with temperature sensing surface 36 is shown along with a mounting plate 50 and a tube mounting clip 52. Mounting plate 50 is composed of good thermally conductive material such as aluminum and is generally flat having a maximum dimension approximately the same as the diameter of surface 36 so that the thermostat can be more easily handled whether or not the mounting plate is attached. Plate 50 is formed with spaced tab receiving recesses 50.1 in communication with respective two opposite ends of the plate.

Tube mounting clip 52, of relatively strong material such as stainless teel, is generally U-shaped having a flattened bight 54 and depending opposed legs 56. Bight 54 is formed with a cut out portion 60 of a size to receive therein mounting plate 50 as will be described below. Legs 56 are each formed with an arm 62 which lies generally in the same plane as the respective leg from which it was formed but has a distal end portion bent over to form a tab 64. The length of clip 52, as well as the width, is selected to be approximately the same as the diameter of circular temperature sensing surface 36. Legs 56 are each formed with a portion 58 bent inwardly toward each other and with an outwardly flared distal end portion 59.

Mounting plate 50 is attached to surface 36 as by ultrasonically welding it to optimize thermal coupling therebetween. Arms 62 of clip 52 are pushed apart and plate 50 is inserted with the tabs inserted in recesses 50.1. The clip and switch mounted thereon are then placed on a tube having a diameter greater than the distance between portions 58 so that the tube is tightly held against mounting plate 50 in good thermal communication therewith. The clip is placed on the tube by spreading distal portions 59 apart.

FIGS. 11–15 show the use of modified mounting plate 70. Plate 70 is formed of good thermally conductive material such as aluminum and is generally flat except for a recessed groove portion 72 extending across the width of the plate. Plate 70 having a diameter generally the same as the diameter of surface 36 of cup member 34 to facilitate handling of the switch is welded thereto. An aperture 74 is formed in plate 70 in the grooved area for a purpose to be described below. After assembly of the thermostatic switch is completed, a strap portion 76 of a mounting element 78 is pushed into and received in groove portion 72. A projection 80 is formed on strap portion 76 which is received in aperture 74 to lock element 78 in a selected position in groove 72. Element 78 is generally U-shaped with strap 76 forming one leg and the second leg 82 formed with generally V-sahped portion 84 adapted to receive a tube whose surface is to be monitored. Leg 82 is bent back toward leg 76 and can be biased apart for reception of the tube. Suitable strong material having spring characteristics such as stainless steel can be employed for clip 78.

Figure 14:
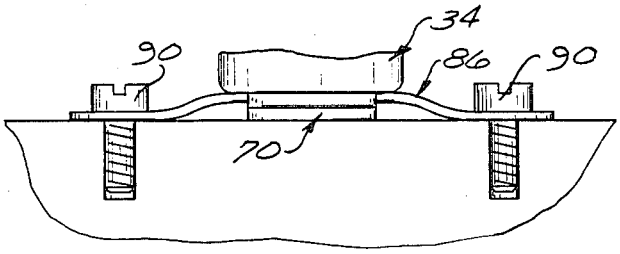
FIG. 14 is a side view of a mounting strap used to attach the switch to a flat surface whose temperature is to be monitored.
Figure 15:
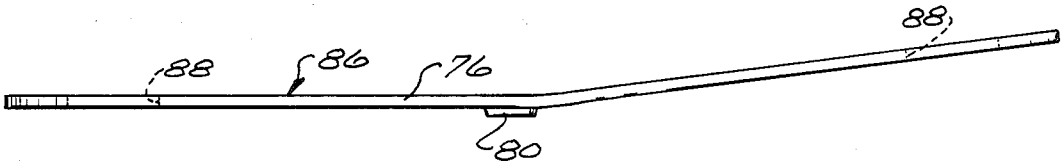
FIG. 15 is an enlarged view of the strap of FIG. 14.

FIGS. 14 and 15 show another mounting element 86, also preferably of stainless steel for the same reasons as used for clips 52 and 78. Element 86 has a strap portion 76 and projection 80 for reception in groove portion 72 of mounting plate 70 but is generally flat having an aperture 88 at each end for reception of conventional fasteners 90 to securely mount the element to a surface whose temperature is to be monitored. Preferably element 86 is bent slightly from projection 80 toward one end to form a slightly bowed surface with the convex side of the bend facing away from temperature sensing surface 36 of the cup shaped member 34 to facilitate handling so that projection 80 will be maintained in aperture 88 prior to mounting to the surface to be monitored. During installation the bend in strap 76 yields under the influence of fasteners 90.

Thus it will be seen that the two part seal comprising a thermally conductive metallic cup shaped member with extended side walls to enable a first seal between the metallic member and a plastic sleeve and the plastic sleeve having a flattened tubular portion to facilitate a second seal between opposed flat wall portions of the tubular portion and aligned plastic layers of leads extending therethrough results in an effective seal which has a fast response time, i.e., is sensitive to temperature changes, and allows the mounting of such a sealed switch to a surface whose temperature is to be monitored in a way that best utilizes the temperature sensing surface of the cup shaped member 34. That is, mounting plates 50 and 70 are both directly attached in optimum heat transfer relation with the temperature sensing surface with the surface whose temperature is to be monitored being biased against the mounting plate. In addition the clip or strap which is in direct contact with the surface to be monitored is also in contact with the temperature sensing surface to enhance the thermal response of the switch. It will be understood that it is within the purview of the invention to modify the housing of switch 16 so that cap 30 is formed with an upstanding wall to directly receive sleeve 40 and form a seal therewith rather than mounting the general purpose switch in a separate cup shaped member 34.

In view of the above it will be seen that the several objects of the invention are achieved and other advantageous results attained.

What is claimed is:

1. A switch having an open ended body with a movable and a stationary electrical contact disposed in the body, the movable contact movable into and out of engagement with the stationary contact, a heat responsive member disposed in the body operatively connected to the movable contact to cause the movable contact to assume one of it spositions of engagement or disengagement depending on the temperature of the heat responsive member, a heat conductive cap having a heat sensing surface closing the open end of the body and thermally coupled to the heat responsive member, terminal means on the body to provide electrical connections to the movable and stationary contact and insulated electrical leads connected to the terminal means and projecting from the body, an improved liquid tight seal for the switch comprising a heat conductive metallic cup shaped member having a tubular side wall and closed end formed with a recessed portion in the closed end, the heat conductive cap received in the recessed portion with the heat sensing surface thermally coupled to the closed end, the closed end clampingly engaged with the heat conductive cap, a continuous layer of adhesive about the side wall of the cup shaped member, a plastic sleeve having first and second open ends, one end received over the tubular side wall and the second extending above the switch, the first end of the sleeve being bonded to the side wall through the adhesive to form a liquid tight seal between the sleeve and the cup shaped member, the leads extending through the second end of the sleeve, and the second end of the sleeve being bonded to itself and to the insulation of the leads to form a liquid tight seal between the sleeve and the insulated sleeves of the leads.

2. A switch according to claim 1 in which the insulated electrical leads extend in a direction generally perpendicular to a plane in which the heat sensing surface lies.

3. A switch according to claim 1 in which the insulated electrical leads extend in a direction generally parallel to a plane in which the heat sensing surface lies.

4. A switch according to claim 1 in which the recessed portion in the cup shaped member is spaced a selected distance from the tubular side wall to provide desired electrical clearance between the terminals.

5. A switch according to claim 1 in which the sleeve and the insulation of the electric leads is made of vinyl.

6. A switch according to claim 1 in which the sleeve has a double wall, one wall received outside the tubular side wall of the cup shaped member and the second wall received inside the tubular side wall of the cup shaped member.

7. A switch according to claim 1 in which a mounting plate means is fixed to the bottom surface of the cup shaped member for mounting the switch to a surface whose temperature is to be mounted.

8. A switch accoridng to claim 7 in which the mounting plate means includes a strap disposed intermediate the bottom surface of the cup shaped member and a mounting plate fixed to the bottom surface of the cup shaped member.

9. A switch according to claim 8 in which the mounting plate is formed with a strap receiving portion and a projection is formed on one of the strap receiving portion of the mounting plate and the strap and a projection receiving aperture is provided on the other of the strap receiving portion of the mounting plate and the strap to maintain the strap at a selected location relative to the bottom surface of the cup shaped member.

10. A switch according to claim 9 in which the strap forms one leg of a generally U-shaped clip, the other leg formed with a generally V-shaped tube receiving section.

11. A switch according to claim 9 in which the strap is generally flat but is formed with a slight outwardly facing convex bend, the strap having fastener receiving apertures at each of two opposite ends.

12. A switch according to claim 7 in which the mounting plate means includes a plate having two opposite ends and a recessed tab receiving portion is formed at each of the ends, and further including a genrally U-shaped clip having two legs extending from a generally flat bight, the bight having a cut out portion adapted to fit over the plate, the legs adapted to clampingly engage a tube and maintain it in close thermal contact with the plate, and tabs extending from the legs into the cut out portion and received in the tab receiving portions.

13. An electrical switch comprising a housing, a heat responsive member, a stationary and a movable contact mounted in the housing, the movable contact adapted to move into and out of engagement with the stationary contact under the influence of the heat responsive member, electrical terminal means electrically connected to the contacts and extending from within the housing to without the housing, leads having a plastic insulating layer connected to the terminals, a metallic cup shaped member having a temperature sensing bottom wall and an upstanding wall extending therefrom, the heat responsive member thermally coupled to the temperature sensing bottom wall, a plastic sleeve received about the periphery of the upstanding wall and sealingly connected thereto, the sleeve having an opening through which the leads extend, the opening being closed by the plastic of the sleeve adjacent to the opening and aligned portions of the plastic layer of the leads being coalesced together, a generally flat mounting plate welded to the outside surface of the temperature sensing bottom wall, a recess formed between a portion of the mounting plate and the temperature sensing bottom wall and an element connectable to a surface whose temperature is to be monitored having at least a portion received in the recess to connect the element to the mounting plate.

14. A thermally responsive electrical switch comprising a housing, a stationary and a movable contact mounted in the housing, the movable contact adapted to move into and out of engagement with the stationary contact, temperature responsive means to cause the movable contact to move between its engaged and disengaged position with the stationary contact in response to selected temperature conditions, electrical terminal means electrically connected to the contacts, the switch having a metallic temperature sensing bottom wall, a generally flat mounting plate welded to the outside surface of the temperature sensing bottom wall, a recess formed between a portion of the mounting palte and, the temperature sensing bottom wall and an element connectable to a surface whose temperature is to be monitored having at least a portion received in the recess to connect the element to the mounting plate, the element including a strap and the recess being a strap receiving portion, and a projection is formed on one of the strap receiving portion of the mounting plate and the strap and a porjection receiving aperture is provided on the other of the strap receiving portion of the mounting plate and the strap to maintain the strap at a selected location relative to the bottom surface of the cup shaped member.

15. A switch according to claim 14 in which the strap forms one leg of a generally U-shaped clip, the other leg being formed with a generally V-shaped tube receiving section.

16. A switch according to claim 14 in which the strap is generally flat but is formed with a slight outwardly facing convex bend, the strap having fastener receiving apertures at each of two opposite ends, the convex bend serving to ensure optimum heat coupling of the strap with a surface when fastened thereto by fasteners extending through the fastener receiving apertures.

17. A thermally responsive electrical switch comprising a housing, a stationary and a movable contact mounted in the housing, the movable contact adapted to move into and out of engagement with the stationary contact, temperature responsive means to cause the movable contact to move between its engaged and disengaged position with the stationary contact in response to selected temperature conditions, electrical terminal means electrically connected to the contacts, the switch having a metallic temperature sensing bottom wall, a generally flat mounting plate welded to the outside surface of the temperature sensing bottom wall, a recess formed between a portion of the moutning plate and the temperature sensing bottom wall and an element connectable to a surface whose temperature is to be monitored having at least a portion received in the recess to connect the element to the mounting plate, the mounting plate having two opposite ends and the recess being formed at each of the ends, and further including a generally U-shaped clip having two legs extending from a generally flat bight, the bight having a cut out portion adapted to fit over the plate, the legs adapted to clampingly engage a tube and maintain it in close thermal contact with the plate, and tabs extending from the legs into the cut out portion and received in the tab receiving portions.

18. An electrical switch comprising a housing, a heat responsive member, a stationary and a movable contact mounted in the housing, the movable contact adapted to move into and out of engagement with the stationary contact under the influence of the heat responsive member, electrical terminal means electrically connected to the contacts and extending from within the housing to without the housing, leads having a plastic insulating layer connected to the terminals, a metallic cup shaped member having a temperature sensing bottom wall and an upstanding wall extending therefrom, the heat responsive member thermally coupled to the temperature sensing bottom wall, a plastic sleeve received about the periphery of the upstanding wall and sealingly connected thereto, the sleeve having an opening through which the leads extend and the opening being closed by the plastic of the sleeve adjacent to the opening and aligned portions of the plastic layer of the leads being coalesced together.

19. An electrical switch comprising a housing, a condition responsive member, a metallic member mounting the condition responsive member attached to the housing a stationary and a movable contact mounted in the housing, the movable contact adapted to move into and out of engagement with the stationary contact under the influence of the condition responsive member, electrical terminal means electrically connected to the contacts and extending from within the housing to without the housing, leads having a plastic insulating layer connected to the terminals, the metallic member mounting the condition responsive member having a wall extending therefrom, a plastic sleeve received about the periphery of the wall and sealingly connected thereto, the sleeve having an opening through which the leads extend and the opening being closed by the plastic of the sleeve adjacent to the opening and aligned portions of the plastic layer of the leads being coalesced together.

* * * * *